United States Patent [19]

Hain et al.

[11] Patent Number: 4,471,875

[45] Date of Patent: Sep. 18, 1984

[54] BAG HAVING EASY OPENING CLOSURE

[75] Inventors: Paul O. Hain, Hamilton; J. George Lepisto, Middletown, both of Ohio

[73] Assignee: Champion International Corporation, Stamford, Conn.

[21] Appl. No.: 419,737

[22] Filed: Sep. 20, 1982

[51] Int. Cl.[3] ..... B65D 33/18

[52] U.S. Cl. ..... 206/632; 206/633; 229/485 B; 383/85

[58] Field of Search ..... 229/485 B, 80; 206/631, 206/632, 633; 383/41, 55, 56, 85, 86

[56] References Cited

U.S. PATENT DOCUMENTS

| | | | |
|---|---|---|---|
| Re. 28,317 | 1/1975 | Goodrich | 383/85 |
| 1,981,440 | 11/1934 | Swift | 206/632 |
| 2,099,166 | 11/1937 | Inman et al. | 206/633 |
| 2,133,946 | 10/1938 | Bloomer | 206/633 |
| 3,113,713 | 12/1963 | Green | 206/633 |
| 3,217,871 | 11/1965 | Lee | 206/633 |
| 3,708,106 | 1/1973 | Sargent | 206/632 |

FOREIGN PATENT DOCUMENTS

| | | | |
|---|---|---|---|
| 1540588 | 9/1968 | France | 383/56 |
| 449402 | 4/1968 | Switzerland | 383/86 |
| 891974 | 3/1962 | United Kingdom | 229/176 |

*Primary Examiner*—Stephen P. Garbe
*Attorney, Agent, or Firm*—Evelyn M. Sommer

[57] ABSTRACT

A bag for containing a flowable product comprises a plurality of panels hingedly coupled along fold lines, an opening at one end of the bag, and a flap hingedly coupled to one panel along a fold line for overlapping an opposite panel and closing the opening. An adhesive layer extends across the entire width of the flap to seal the flap to the opposite panel which is provided with an adhesive coating comprising kaolin clay, to facilitate opening of the bag, but which provides sufficient bond strength during shipment and handling to preclude inadvertent opening of the bag.

4 Claims, 3 Drawing Figures

BAG HAVING EASY OPENING CLOSURE

CROSS-REFERENCES TO RELATED APPLICATIONS

This application is related to Applicants' copending U.S. patent applications Ser. No. 413,725, filed Sept. 1, 1982, entitled "Container With Resealable Closure", Ser. No. 413,972, Filed Sept. 1, 1982, entitled "Bag Resealing Clip", and Ser. No. 419,736, , filed Sept. 20, 1982, entitled "Container With Easy Opening Closure".

BACKGROUND OF THE INVENTION

1. Field Of The Invention

The present invention relates to a bag or container having a sealed flap closing one end of the container with the seal having a reduced bonding strength to facilitate opening the bag, while sufficient to maintain the seal prior to opening. More particularly, the present invention relates to a bag having a flap hingedly coupled to one end of the bag and sealed to an adjacent one of the bag panels with the seal across the entire width of the bag having a reduced adhesive bonding strength to facilitate opening of the bag across its entire width so the contents thereof may be readily dispensed.

2. Description Of The Prior Art

Containers or bags formed of heavy weight, multiple ply paper are conventionally employed for containing, storing and shipping flowable, fine powdery materials and small sized granular products, such as starch, food products, chemicals, cement and the like. The flowable nature of these products permits the bags to be filled by inserting a filler spout of a dispensing machine into an opening of the bag and delivering the product from a source through the spout into the bag. The bag construction and filling apparatus for filling bags in this manner are disclosed in U.S. Pat. No. 4,316,574 to Lepisto, which patent is hereby incorporated by reference.

One problem which has plagued bags of this type is the provision of a simple and neat way to open the bags without using tools. Often heavy weight bags have no provision to facilitate opening and require the use of a sharp instrument to cut an opening in the bag. Such opening procedure is inconvenient and dangerous. Additionally, opening the bag using a sharp instrument often results in tearing of the bag preventing proper resealing for storing any remaining bag contents and preventing controlled dispensing of the contents.

Hand opening of heavyweight bags sealed with hot melt adhesive is extremely difficult due to the strength of the bag material and the seal. Force applied to the closing flap will tear the bag since the bond between the adhesive and paper is stronger than the paper itself. Thus, hand opening of such bags is difficult, forms a poor dispensing spout, causes spilling of the contents, and prevents resealing of the bag.

Special mechanisms for opening bags have involved the use of strings, e.g., U.S. Pat. No. 2,203,924 to Pletscher and U.S. Pat. No. 2,151,523 to Orr, the inclusion of a glued tab, e.g., U.S. Pat. No. 3,081,930 to Owens and the use of tape, e.g., U.S. patent application Ser. No. 243,829, filed Mar. 16, 1981, entitled "Easy Open Valve Bag".

The previously tried closure opening mechanisms have suffered from numerous deficiencies, including a high failure rate, difficult and expensive manufacturing, adverse effects on the sealing of the bag and difficult operation. The string often fails by becoming loose from the bag without tearing the bag material and is difficult and expensive to install due to the precise gluing necessary. The thick material of the bag often makes the tab and tape mechanisms difficult to open. Additionally, such opening mechanisms provide a relatively large opening making controlled dispensing of the contents and resealing of the bag difficult.

Thus, previous systems for opening heavyweight bags for powder and granular substances have not been effective since they are difficult and expensive to manufacture, have a high failure rate, are difficult to operate and do not form a neat pouring spout for accurately dispensing the bag contents. Additionally, these systems make it extremely difficult or impossible to reseal the bag to properly store any unused contents in the bag.

SUMMARY OF THE INVENTION

It has now been discovered that the disadvantages associated with conventional systems for opening containers closed by a sealed flap can be eliminated by the present invention which comprises a bag or container seal extending the entire width of the flap and including first and second opposed portions with the first portion having a bond strength significantly less than that of the second portion, thereby facilitating opening of the bag. The container has a body portion, an opening in the body portion providing access to the container interior, and a fold over flap for extending over and closing the opening. The flap is attachable to the body portion by the seal extending generally along the opening.

In this manner, the flap at the first portion of the seal can be easily separated from the body portion to facilitate opening the container, while forming an adequate seal prior to opening. Additionally, containers formed with seals according to the present invention are simple and inexpensive to manufacture, have a low failure rate, and are resealable. The treatment of the seal second portion can be accomplished simply and quickly without adding hardware to the bag itself or substantially modifying the container forming machinery.

Preferably, the container is in the form of a bag having a plurality of panels hingedly coupled along fold lines, an opening on one end of the bag, and a flap hingedly coupled to one of the panels along a fold line for overlapping a portion of an opposite panel and closing the opening. A hot melt adhesive layer extends across the entire width of the flap for adhering the flap to the opposite panel and sealing the opening. The adhesive bonding strength of the hot melt adhesive layer is reduced by providing a regular pattern of adhesive material printed across the entire width of the front or opposite panel of the bag to weaken the heat seal bond and allow easy and quick opening of the bag for a fast discharge of the entire contents. The pattern and area of the adhesive material is designed to provide sufficient seal strength for safe shipment of the contents balanced by an increased ease of totally and quickly exposing the contents and can consist of an alternating triangular array of adhesive and nonadhesive areas across the width of the front panel opposite the flap provided with the hot melt adhesive layer. A preferred form of adhesive is kaolin clay. When the flap is folded and sealed in the conventional manner, the coated areas of adherent reduces, without eliminating, the adhesive bond strength of the seal between the flap and opposite panel portion. At the seal portion, separation occurs between the coated area and the bag flap, rather than at an interface with the hot melt adhesive. A tape may be adhered to the opposite or front panel to aid in separating the coated area and the flap.

The adhesive coating can be printed, sprayed or brushed on the bag during its manufacture. In this manner, the reduced bond strength of the seal is automatically formed during the conventional bag sealing process.

Other advantages and salient features of the present invention will become apparent from the following detailed description, which taken in conjunction with the annexed drawings, discloses a preferred embodiment of the present invention.

DETAILED DESCRIPTION OF THE PREFERRED EMBODIMENT OF THE INVENTION

Figure 1:
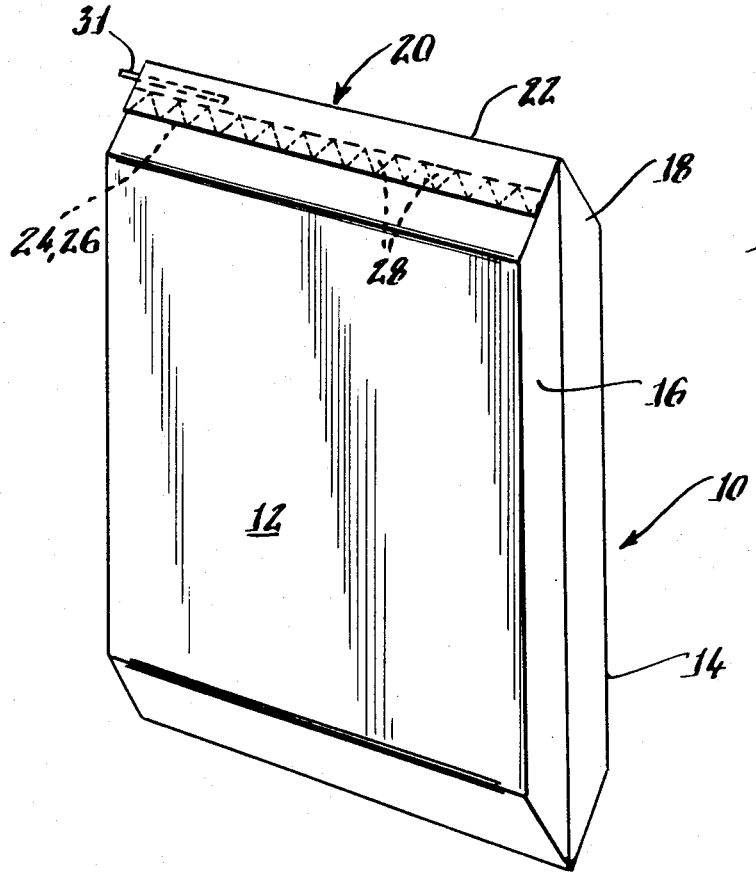
FIG. 1 is a perspective view of a bag in accordance with the present invention.

Referring initially to FIG. 1, the bag 10 of the present invention is primarily intended to contain a flowable matter comprising powdery or granular products, such as starch, food products, chemicals, cement and the like. The bag comprises a plurality of panels which are hingedly coupled along fold lines. Specifically, the bag has parallel front and back panels 12 and 14 joined at each side thereof by a pair of hingedly coupled side panels 16 and 18. A flap 20 is hingedly coupled to the one edge of back panel 14 along fold line 22. When folded over and adhered to front panel 12, flap 20 closes and seals the opening in bag 10 between the front, back and side panels at one end. A similar flap is provided at the opposite end of bag 10 to close the other opening of the bag.

At one corner of bag 10, a suitable filling valve is provided of the type disclosed in U.S. Pat. No. 4,316,574 to Lepisto. Since such valve is fully and adequately disclosed in the Lepisto patent, no further discussion thereof will be provided.

Flap 20 is adhered and sealed to panel 12 by a layer 24 of conventional hot melt adhesive formed on the inner surface of the flap adjacent its distal edge, i.e., remote from fold line 22. Layer 24 extends the entire width of flap 22 in order to completely seal the bag.

A coating 26 provided in an alternating triangular array at areas 28 of suitable adhesive material with nonadhesive portions of panel 12 is formed on the exposed surface of front panel 12. The material of coating 26 upon being heat sealed to the hot melt adhesive layer 24 will reduce the adhesion of the hot melt adhesive coated flap to the adhesive coated panel. Although the spot coating reduces the bond strength at the location thereof, it does not totally eliminate the bond strength so as to provide a seal thereat.

Preferably, the adhesive material of coating 26 should have a fine particle size providing a large surface area capable of reducing the effectiveness of the hot melt adhesive and should have a laminated plate structure, as opposed to a crystal structure such as calcium carbonate. Additionally, the adhesive should be capable of being printed in combination with other materials by flexography and should be inert and/or of food grade material such that the bag can be used to contain food. Also, the adhesive should have very weak adhesion such that it will have enough dry integrity to resist dusting, but will split from the cellulose bag material. Finally, the adhesive material should have easily controlled release characteristics, i.e., relatively large changes in the quantity of material applied will have a relatively minor effect on the release qualities of the coating. The preferred adhesive of the present invention comprises kaolin clay. Kaolin is generally known and used in the paper-making industry as "China Clay". Kaolin has a laminated plate-like particle form, which gives it unparalleled coating properties in aqueous slurries. Its universal abundance in supply, its historical general usage in the paper-making and paper-converting industries and its low cost make it an ideal material. There are many other materials of a mineral nature which can be used instead of and matched against kaolin clays as the standard of perfection. Other types of particulate materials of the necessary adhesive properties are deemed equivalents of kaolin. The adhesive material, preferably kaolin, should be applied in combination with a viscosity modifier, thickener or the like. Bentonite is preferred for such purpose. The addition of such material will reduce settling and facilitate application of the material by flexoprinting.

Other materials which may be used for adhesive coating 26 include, for example, silicones, fluro chemicals and finally ground pearl starch. Although the silicons and fluro chemicals function excellently to reduce the adhesion of the hot melt adhesive-coated flap to the adhesive-coated panel, such materials are disadvantageous due to their high cost.

The bag is formed from multiple plies of paper in a conventional manner. In the illustrated embodiment, each panel has three plies. Additionally, a ply formed of a film of synthetic plastic material can be provided as an innermost ply which is suitably adhered to the innermost paper ply as required depending on the intended contents of the bag. The ends of the plies forming flap 20 are staggered or shingled as illustrated. Thus, the flap includes an outer back ply 30, a middle back ply 32 and an inner back ply 34. The top portion of front panel 12 extends above fold line 22, which top portion is defined by the shingled plies including an outer front ply 36, a middle front ply 38 and an inner front ply 40. Access to the bag interior is obtained by separating inner plies 34 and 40. Since the top portion of upper panel 12 extends above fold line 22 and is partially coated by adhesive layer 24, the bag is securely sealed upon closing and sealing of flap 20 such that the bag contents will not sift or otherwise escape from the bag.

The bag of the present invention is basically formed in a conventional manner from a plurality of paper plies with a layer of adhesive 24 formed on the inner surface of flap 20 at its distal edge. A regular pattern of adhesive material printed across the entire width of the bag to weaken the hot seal bond and allow easy and quick opening of the bag for a fast discharge of the entire contents. The pattern and area of the adhesive material is designed to provide sufficient seal strength for safe shipment of the contents balanced by an increased ease of totally and quickly exposing the contents and can consist of an alternative triangular array of the adhesive and nonadhesive areas across the width of the panel opposite the flap provided with the hot melt adhesive layer. A preferably form of adhesive is kaolin clay. The coating is spaced below fold line 22 a distance corresponding to the spacing of adhesive layer 24 therefrom such that layer 24 and coating 26 will overlap upon folding of flap 20 about line 22. Thus, except for the formation of coating 26, bag 10 of the present invention is formed in a conventional manner.

Figure 2:
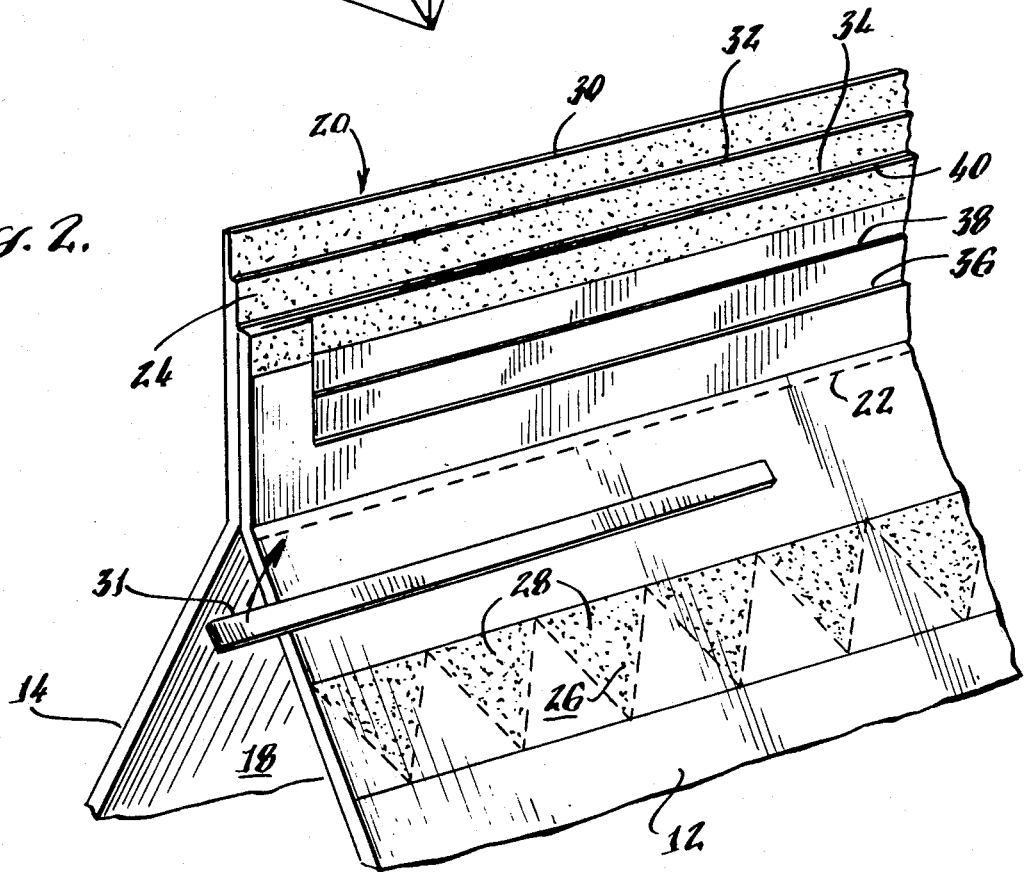
FIG. 2 is a partial, enlarged view of the bag of FIG. 1 after it has been opened.
Figure 3:
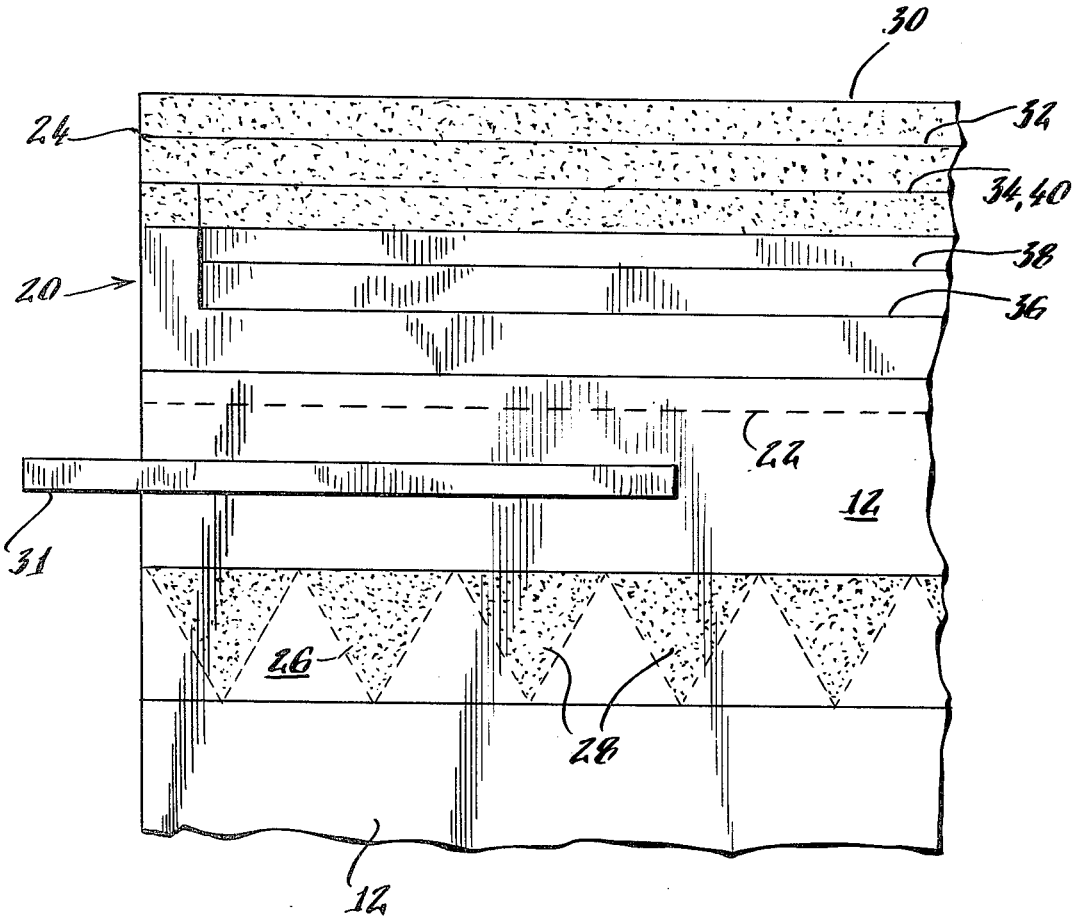
FIG. 3 is a partial, enlarged top plan view of the bag of FIG. 1 prior to folding and sealing of the flap to close the bag opening.

Upon adhering flap 20 to panel 12, a highly effective seal is provided for the bag. The bag can be easily opened by hand by pulling a tape 31 adhered to bag panel 12 above coating 26 to raise the corner of flap 20 adjacent its distal edge and coating 26. The reduced bond strength of the hot melt adhesive resulting from the provision of coating 26 causes the flap to separate easily from panel 12 along the coating. The flap 22 is then fully pulled to an upright condition as illustrated in FIG. 2. By separating inner plies 24 and 40 the bag contents can be easily dispensed. The bag may be reclosed by refolding the raised portion of flap 20 until adhesive 24 no longer retains its functionality.

The following examples illustrate preferred embodiments of the present invention, wherein parts by weight are used unless otherwise specified:

EXAMPLE I

A mixture is formed of 33 parts kaolin clay (such as "Beta Cote" coating clay, 10 parts bentonite (e.g., Georgia Kaolin "Mineral Colloid MO") and 100 parts water are mixed to form in a mixture which is 30% total solids. The preparation of this mixture produces a flowable, gel material.

The resulting adhesive is applied to the exterior surface of the opposite paper panel along the width of the bag at a rate of 3 to 7 pounds of material per 3300 square feet. The clay adhesive layer forms a weak separation plane between the hot melt adhesive and the paper. The bentonite is a very weak film former and viscosity builder which reduces settling of the clay and prevents the clay from dusting off when dried.

EXAMPLE II

A mixture is formed from the combination of 10 parts kaolin clay (normally used as paper fillers), 20 parts bentonite (Georgia Kaolin "Mineral Colloid MO"), 100 parts water, and 100 parts isopropyl alcohol resulting in a mixture comprising 13% total solids. The mixture is prepared by placing the water in a shear mixer, adding the clay and then slowly adding the bentonite to obtain a smooth, thick material. The isopropyl alcohol is added to reduce viscosity to a practical level. The resulting adhesive is applied to the exterior surface of the opposite paper panel along the width of the bag at a rate of 3 to 7 pounds of material per 3300 square feet. The clay adhesive layer forms a weak separation plane between the hot melt adhesive and the paper. The bentonite is a very weak film former and viscosity builder which maintains the clay in suspension and prevents dusting. The alcohol increases wetting speed and reduces drying time, as well as modifying viscosity and flow characteristics. The mixture forms a smooth, uniform, free flowing gel that is easily applied by print coating or other conventional methods for forming spot coatings of this type.

Although the invention has been described in considerable detail, with particular reference to a certain preferred embodiment thereof, variations and modifications can be effected within the scope and spirit of the invention as defined in the appended claims.

What is claimed is:

1. In a bag for containing a flowable product, an easy open closure comprising:

(a) a front panel;

(b) a back panel;

(c) a closure flap foldably connected to said back panel along a fold line, said closure flap overlying said front panel and having a free edge spaced from and parallel to said fold line;

(d) a layer of adhesive disposed between said flap and said front panel defining an adhesive bond to secure said flap in overlying relationship with said front panel, said adhesive continuing across the full width of said flap and front panel and extending from said free edge of said flap toward said fold line whereby said adhesive layer has a first edge contiguous with said free edge of said flap and a second edge disposed between said free edge of said flap and said fold line;

(e) an adhesive-free zone disposed between said fold line and said second edge of said adhesive layer;

(f) a repetitive pattern of adhesive material disposed between said adhesive layer and one of said flap and front panel to weaken the adhesive bond between said flap and front panel, said adhesive pattern being restricted to a plurality of spaced points of adhesive disposed along said first edge of said adhesive layer, with said adhesive progressively increasing in area toward said second edge of said adhesive layer whereby said adhesive pattern forms a substantially continuous line of adhesive at said second edge of said adhesive layer to form a bond between said flap and said front panel which has maximum strength at said first edge of said adhesive layer and minimum strengh at said second edge of said adhesive layer; and (g) a pull tape sandwiched between said flap and said front panel in said adhesive-free zone, said pull tape being accessible and operable, upon being pulled, to initiate failure of the adhesive bond between said flap and said front panel from said second edge of said adhesive layer toward said first edge of said adhesive layer.

2. The bag of claim 1, wherein said adhesive pattern comprises a plurality of adjacent triangles of adhesive with the vertices of said adhesive triangles being disposed along said first edge of said adhesive layer and the bases of said adhesive triangles being disposed along said second edge of said adhesive layer.

3. In a bag for containing a flowable product, an easy open closure comprising:

(a) a front panel;

(b) a back panel;

(c) a closure flap foldably connected to said back panel along a fold line, said closure flap overlying said front panel and having a free edge spaced from and parallel to said fold line;

(d) a layer of adhesive disposed between said flap and said front panel defining an adhesive bond to secure said flap in overlying relationship with said front panel, said adhesive continuing across the full width of said flap and front panel and extending from said free edge of said flap toward said fold line whereby said adhesive layer has a first edge contiguous with said free edge of said flap and a second edge disposed between said free edge of said flap and said fold line;

(e) an adhesive-free zone disposed between said fold line and said second edge of said adhesive layer;

(f) a repetitive pattern of adhesive material disposed between said adhesive layer and one of said flap and front panel to weaken the adhesive bond between said flap and front panel, said adhesive pattern comprising a plurality of adjacent triangles of adhesive with the vertices of said adhesive triangles being disposed along said first edge of said adhesive layer and the bases of said adhesive triangles being disposed along said second edge of said adhesive layer; and (g) a pull tape sandwiched between said flap and said front panel in said adhesive-free zone, said pull tape being accessible and operable, upon being pulled to initiate failure of the adhesive bond between said flap and said front panel from said second edge of said adhesive layer toward said first edge of said adhesive layer.

4. In a container for containing a flowable product, an easy open closure comprising:

(a) a front panel;

(b) an adjacent panel;

(c) a closure flap foldably connected to said adjacent panel along a fold line, said closure flap overlying said front panel and having a free edge spaced from and parallel to said fold line;

(d) an adhesive disposed between said flap and said front panel defining an adhesive bond to secure said flap in overlying relationship with said front panel, said adhesive continuing across substantially the full width of said flap and front panel and said adhesive having a first edge substantially underlying said free edge of said flap, and a second edge disposed between said first edge and said fold line;

(e) an adhesive-free zone disposed between said fold line and said second edge of said adhesive;

(f) means providing said adhesive bond with a relatively high bond strength at said first edge of said adhesive, and a relatively low bond strength at said second edge of said adhesive; and (g) manually graspable means sandwiched between said flap and said front panel in said adhesive-free zone operable upon being grasped and pulled to initiate failure of the adhesive bond between said flap and said front panel from said second edge of said adhesive toward said first edge of said adhesive.

* * * * *